US006511632B1

(12) United States Patent
Choi et al.

(10) Patent No.: US 6,511,632 B1
(45) Date of Patent: Jan. 28, 2003

(54) CATHODE MATERIAL OF ELECTRON BEAM DEVICE AND PREPARATION METHOD THEREOF

(75) Inventors: Jong-Seo Choi, Suwon (KR); Yoon-Chang Kim, Suwon (KR); Kyu-Nam Joo, Suwon (KR); Nikolay Osaulenko, Kiev (UA); Vladislav Shutovsky, Kiev (UA); Oleg Kultashev, Fryasino Moskovskoi (RU)

(73) Assignee: Samsung SDI Co., Ltd., Kyungki-do (KR)

( * ) Notice: Subject to any disclaimer, the term of this patent is extended or adjusted under 35 U.S.C. 154(b) by 0 days.

(21) Appl. No.: 09/806,164

(22) PCT Filed: Oct. 1, 1999

(86) PCT No.: PCT/KR99/00599

§ 371 (c)(1),
(2), (4) Date: Jun. 26, 2001

(87) PCT Pub. No.: WO00/21110

PCT Pub. Date: Apr. 13, 2000

(30) Foreign Application Priority Data

Oct. 5, 1998 (UA) ..... 98105226

(51) Int. Cl.[7] ..... C22C 28/00

(52) U.S. Cl. ..... 420/461; 420/590; 219/146.21; 219/146.22

(58) Field of Search ..... 420/461, 590; 219/146.21, 146.22

(56) References Cited

U.S. PATENT DOCUMENTS

| | | | | | |
|---|---|---|---|---|---|
| 2,070,451 | A | * | 2/1937 | Powell et al. | 420/461 |
| 3,163,744 | A | * | 12/1964 | Acousky et al. | 219/137 R |
| 3,463,636 | A | * | 8/1969 | Orgren | 338/334 |
| 3,918,965 | A | * | 11/1975 | Inouye et al. | 420/461 |
| 4,895,592 | A | * | 1/1990 | Hatwar et al. | 148/301 |
| 5,773,922 | A | * | 6/1998 | Lee et al. | 313/346 R |

FOREIGN PATENT DOCUMENTS

| | | | | |
|---|---|---|---|---|
| SU | 387453 | * | 6/1973 | H01J/1/14 |

OTHER PUBLICATIONS

English translation of RU 387453, puglised Jun. 21, 1973 by DuBois et al.*
Derwent abstract of RU 2052855 published Jan. 20, 1996.*
Derwent abstract of SU387453 published Nov. 13, 1973.*

* cited by examiner

*Primary Examiner*—Roy King
*Assistant Examiner*—Tima McGuthry-Banks
(74) *Attorney, Agent, or Firm*—Leydig, Voit & Mayer, Ltd.

(57) ABSTRACT

A cathode material of an electron beam device comprising 0.5 to 9.0% by weight of a rare-earth metal of the cerium group, 0.5 to 15.0% by weight of tungsten and/or rhenium, 0.5 to 10% by weight of hafnium and the balance of iridium is provided. Since the cathode material has excellent plasticity, it is easy to manufacture small-size emitters. Also, since the density of the electron emission of the cathode material is high and the working temperature is low, a long lifetime can be ensured. Also, the cathode material is useful as a cathode material of an electron beam device.

6 Claims, 6 Drawing Sheets x2400

×2400 x2400 x2400 x2400

CATHODE MATERIAL OF ELECTRON BEAM DEVICE AND PREPARATION METHOD THEREOF

TECHNICAL FIELD

The present invention relates to a cathode material of an electron beam device and a preparation method thereof, and more particularly, to a cathode material used as an electron emitting source of various evacuated electron beam devices and cathode-ray tubes, and a preparation method thereof.

BACKGROUND ART

Cathode-ray systems currently in widespread use are mostly based on emission systems with oxide cathode indirectly heated by a filament. However, since these systems have a limit in their emission ability, it is not possible to receive a current density of more than 1 $A/cm^2$.

Also, the oxide cathode is fragile and adhesiveness to a metal substrate on which it is mounted is low, which results in early decay of cathode-ray systems with these types of cathodes. That is to say, in the case when even one of three oxide cathodes for a color picture tube is damaged, the whole system, which is expensive, will go out of order.

To overcome the drawback, attempts to apply highly efficient metal-alloy cathodes, which are free from the above-described problem, to a cathode-ray system have been actively made.

For example, it is known that a metal cathode based on lanthanum hexaboride ($LaB_6$) is stronger than the oxide cathode and has a better emission capability than the oxide cathode. In fact, a monocrystal cathode of hexaboride can provide a high current density of about 10 $A/cm^2$. However, despite the high emission ability of cathodes based on lanthanum hexaboride ($LaB_6$), they have been used only in limited evacuated electron devices whose cathode units are replaceable since the lifetime of them is short. The short lifetime of cathodes based on lanthanum hexaboride ($LaB_6$) is caused by their high activity to constituent materials of a heater. That is to say, lanthanum hexaboride ($LaB_6$) contacts the heater constituent materials, for example, tungsten, to produce a number of fragile chemical compounds.

As a material having a high specific density of electron emission, alloy of iridium and small amounts of rare-earth metals of cerium group (lanthanum, cerium, praseodymium, neodymium, samarium) is well-known (see S. E. Rozhkov et al. "Work Function of the Alloy of iridium with lanthanum, cerium, praseodymium, neodymium, samarium", Journal of Radiotechnika I electronika, 1969, Vol. 14, No. 5, p. 936-analogue).

However, the alloy is characterized by reduction in velocity of the drift of active components to the surface of the cathode which decreases during the operation of the cathode, resulting in a quick increase of the work function with time, decrease in the cathode's emissive properties and decrease in the cathode's resistance to ion bombardment. Also, it is not easy to manufacture a cathode unit using the binary alloy due to its brittleness. Further, since the melting point of the alloy is low, it may result in its collapse due to occasional and short-term technological leaps of temperature above the operating level. Thus, the above-described drawbacks of this material do not make it suitable for long-term and reliable operation of electronic devices.

In Author's certificate of USSR No. 616662, published in Bulletin of Information No. 27, 1978-the analogue, a cathode material representing a ternary alloy of iridium, cerium and hafnium is disclosed. Although this material has excellent emission stability and high plasticity, it still has a low melting point, which makes it impossible to be applied to electron devices desired cathode of a high operating temperature.

Also, in Russian Federation Patent No. 2052855, a cathode material representing alloy of iridium, lanthanum or cerium, tungsten and/or rhenium is disclosed. According to this patent the lifetime of the cathode can be improved by tungsten or rhenium contained in the alloy. However, since tungsten or rhenium is brittle, it makes the cathode more brittle and thereby complicates the procedure of cathode manufacturing. It also decreases the electron-emissive properties of the cathode.

DISCLOSURE OF THE INVENTION

To solve the above problems, it is an objective of the present invention to provide a cathode material of an electron beam device with excellent electron-emissive property, prolonged lifetime and improved mechanical properties.

Accordingly, to achieve the above objective, there is provided a cathode material of an electron beam device comprising 0.5 to 9.0% by weight of a rare-earth metal of the cerium group, 0.5 to 15.0% by weight of tungsten and/or rhenium, 0.5 to 10% by weight of hafnium and the balance of iridium.

It is another objective of the present invention to provide a method of preparing a cathode material having excellent uniformity in view of its chemical composition and microstructure, without a residual gas.

According to another aspect of the present invention, there is provided a method of preparing a cathode material, including the steps of (a) preparing $Ir_5Ce$ by melting ridium and cerium, (b) preparing $Hf_3W$ by melting hafnium and tungsten, and (c) melting the alloy of the $Ir_5Ce$ and $Hf_3W$ prepared in steps (a) and (b) to prepare an ingot of the quaternary alloy.

BRIEF DESCRIPTION OF THE DRAWINGS

The above objectives and advantages of the present invention will become more apparent by describing in detail a preferred embodiment thereof with reference to the attached drawings in which.

BEST MODE FOR CARRYING OUT THE INVENTION

Figure 1A:
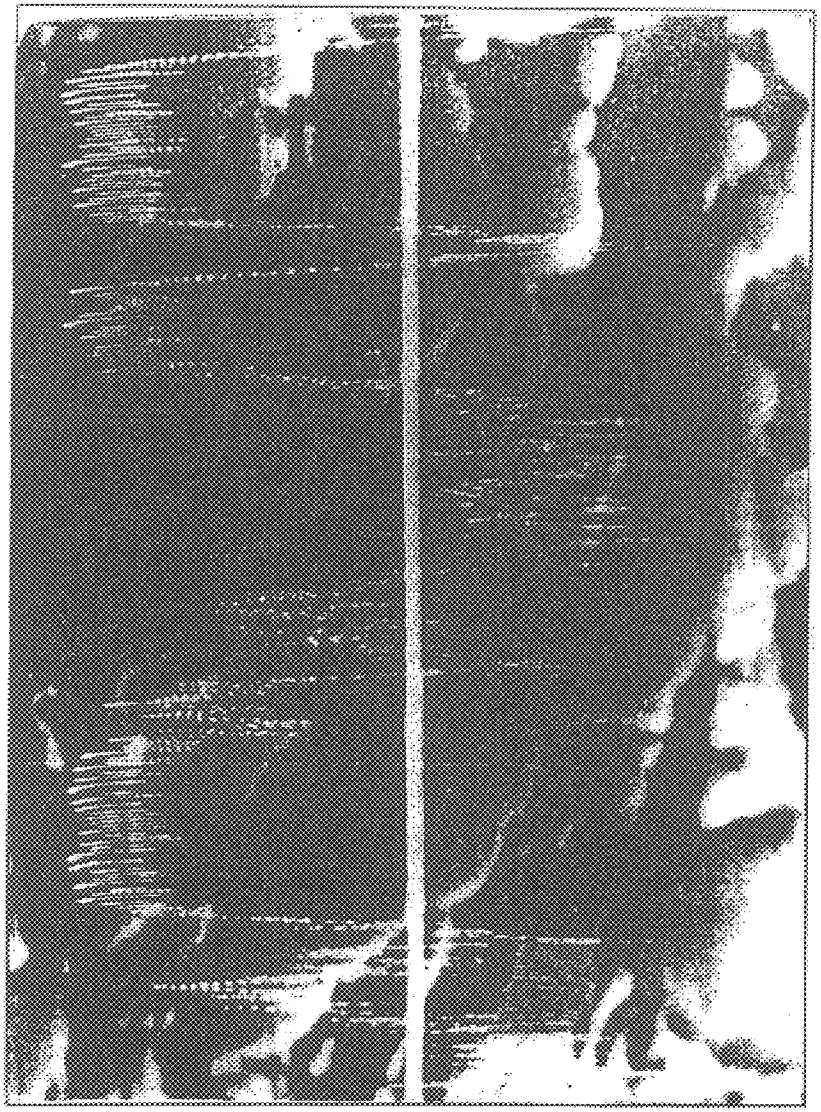
FIGS. 1A through 1D show scanning electron microscopy (SEM) pictures of a quaternary alloy according to an embodiment of the present invention, and the profiles of the contents of cerium, tungsten. hafnium and iridium contained in the alloy, respectively.

The emissive and mechanical properties of the cathode material according to the present invention are both enhanced by introducing a predetermined amount of tungsten and/or rhenium, and hafnium to the cathode material consisting of iridium and a rare-earth metal of the cerium group. In other words, in the alloy of the present invention, hafnium serves to cut down the work function of the alloy and to increase the plasticity thereof, while retaining a high electron-emitting capability at lower temperatures. Introduction of hafnium into material of emitter simplifies the process of manufacturing small-size emitters using the alloy of the present invention and facilitates joining of the emitters to heaters, because hafnium reduce the brittleness of material of emitter. Also, the melting point of the alloy can be increased by introducing tungsten or rhenium thereto.

A quaternary alloy of the present invention containing hafnium has a double phase, that is, a gray phase in which only cerium and iridium are contained substantially, and a white phase in which tungsten, hafnium and iridium are contained substantially. The white phase containing hafnium has a dense crystal structure and increases the plasticity of the alloy. Also, it increases the diffusion rate of cerium into the alloy surface at the phase boundary, thereby lowering the working temperature of an emitter to thus prolong the lifetime of the emitter.

The alloy for the cathode of the present invention contains 0.5 to 9.0% by weight of a rare-earth metal of the cerium group. If the content of the rare-earth metal of the cerium group is less than 0.5% by weight, the lifetime of the cathode is shortened due to a deficiency in the rare-earth metal of the cerium group which is an active component. On the other hand, if the content of the rare-earth metal of the cerium group is greater than 9.0% by weight, a compound such as $Ir_2Ce$ or $Ir_2La$. having a low emissive property may be formed on the surface of the cathode. Here, the rare-earth metal of the cerium group is preferably at least one selected from the group consisting of lanthanum, cerium, praseodymium, neodymium and samarium.

The alloy for the cathode of the present invention contains 0.5 to 15.0% by weight of tungsten and/or rhenium. The content of tungsten and/or rhenium is selected within a limit at which the plasticity and emissive capability of the alloy are not deteriorated, and if the content thereof is less than 0.5% by weight, the melting point of the alloy is lowered, which makes it impossible for the cathode to operate at high working temperatures. If the content of tungsten and/or rhenium is greater than 15.0% by weight, the plasticity and emissive capability of the cathode are deteriorated.

Also, the alloy for the cathode of the present invention contains 0.5 to 10% by weight of hafnium. Since the inventors of Russian Federation Patent No. 2052855 considered that introduction of hafnium would decrease the emissive properties of the alloy, hafnium was not introduced into the alloy. However, decrease of an emissive properties is related with overdose of hafnium, which naturally results in decrease of content of actively emitting components. So, the correct choice of hafnium content in the alloy according to the present invention improves both its emissive and mechanical properties. If the content of hafnium is less than 0.5% by weight, the work function and working temperature increase, thereby resulting in a negligible effect of increasing the lifetime of the cathode and increasing the brittleness of the alloy. If the content of hafnium is greater than 10% by weight, the content of iridium is comparatively reduced, thereby deteriorating the emissive capability of the alloy and lowering the melting point of the alloy. The content of hafnium is preferably in the range of 2~5% by weight.

Hereinbelow, a method for preparing a quaternary alloy according to the present invention will be described in detail by way of examples.

First, gettering is performed to remove gas impurities in a chamber before melting ingot. Subsequently, iridium and cerium are melted in an argon-arc furnace to form $Ir_5Ce$. Here. since it is difficult to form an intermetallic compound due to a considerable difference in the specific weight between iridium and cerium, the material subject to melting is overturned several times during melting to facilitate the reaction between two metals. Then, hafnium and tungsten are melted to form $Hf_3W$. Next, the alloy of the prepared $Ir_5Ce$ and $Hf_3W$ is also melted. Here, gettering may be further performed 2 to 3 times while melting metals. The reason for preparing the respective binary alloys and then mixing and melting the same, instead of melting the respective components of the quaternary alloy altogether, is to increase chemical and micro-structural uniformity.

Residual gas or CeO may exist in the ingot having undergone the mixing and melting process with respect to the quaternary alloy. Thus, the ingot is slantingly placed on the wall of a concave boat-shaped bottom plate in arc furnace and then arc discharge is performed on the edge of the ingot. Then, the ingot is partially melted and the melt flows into the center of the arc furnace. At this time, the gas and CeO present inside the ingot are removed.

Subsequently, the gas-removed ingot is re-melted. and then solidified slowly so that cracks are not generated to adjust the sizes of grains within the ingot, thereby preparing the ingot with improved electron-emitting capability.

The present invention will be described in more detail through the following examples, and is not to be taken by way of limitation.

Phase Analysis of Alloy

A scanning electron microscopy (SEM) picture of a quaternary alloy consisting of 6% by weight of cerium, 2% by weight of tungsten, 6% by weight of hafnium and the balance of iridium is obtained using a superprobe 733 apparatus. For line analysis of an X-ray spectrum, an electron beam having a diameter of 2 $\mu$m is scanned onto the central portion of the alloy in the SEM picture (white lines in FIGS. 1A through 1D) to obtain a content profile of the respective metals. Then, profiles of the metal contents on the alloy surface depending on the line are shown on the pictures for easy comparison of the metal contents in respective phase.

Figure 1B:
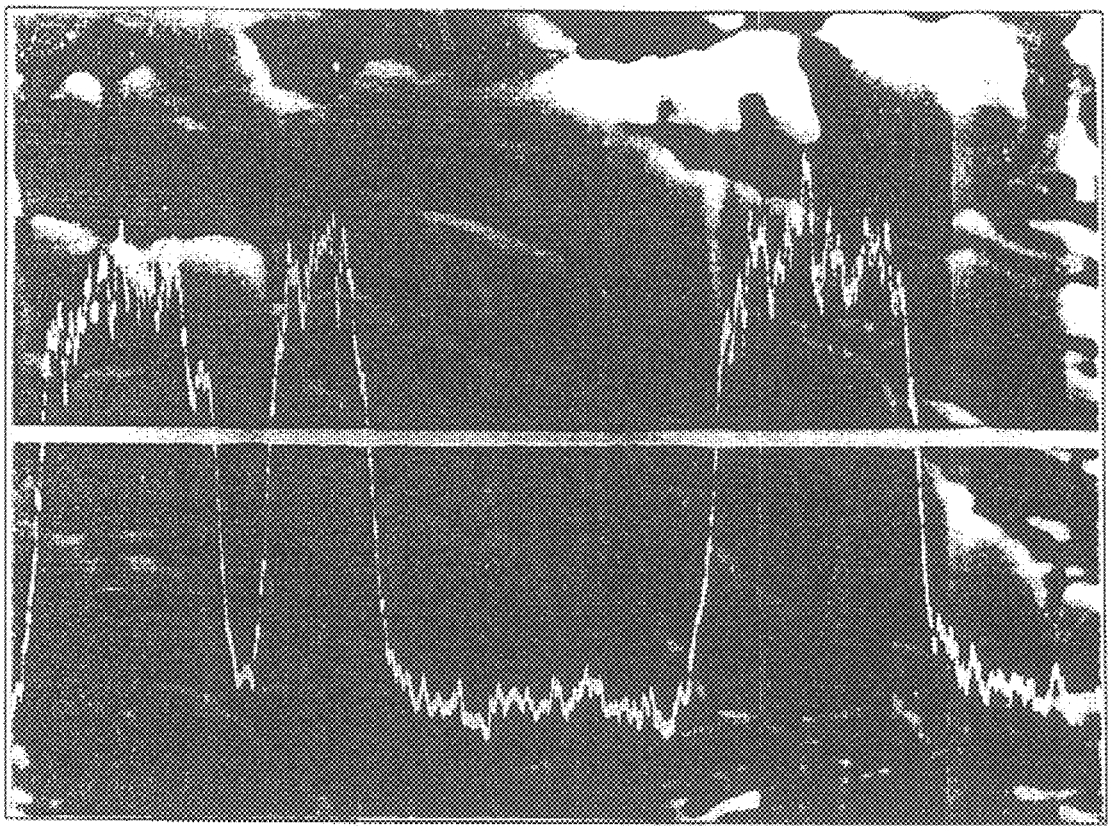
Figure 1C:
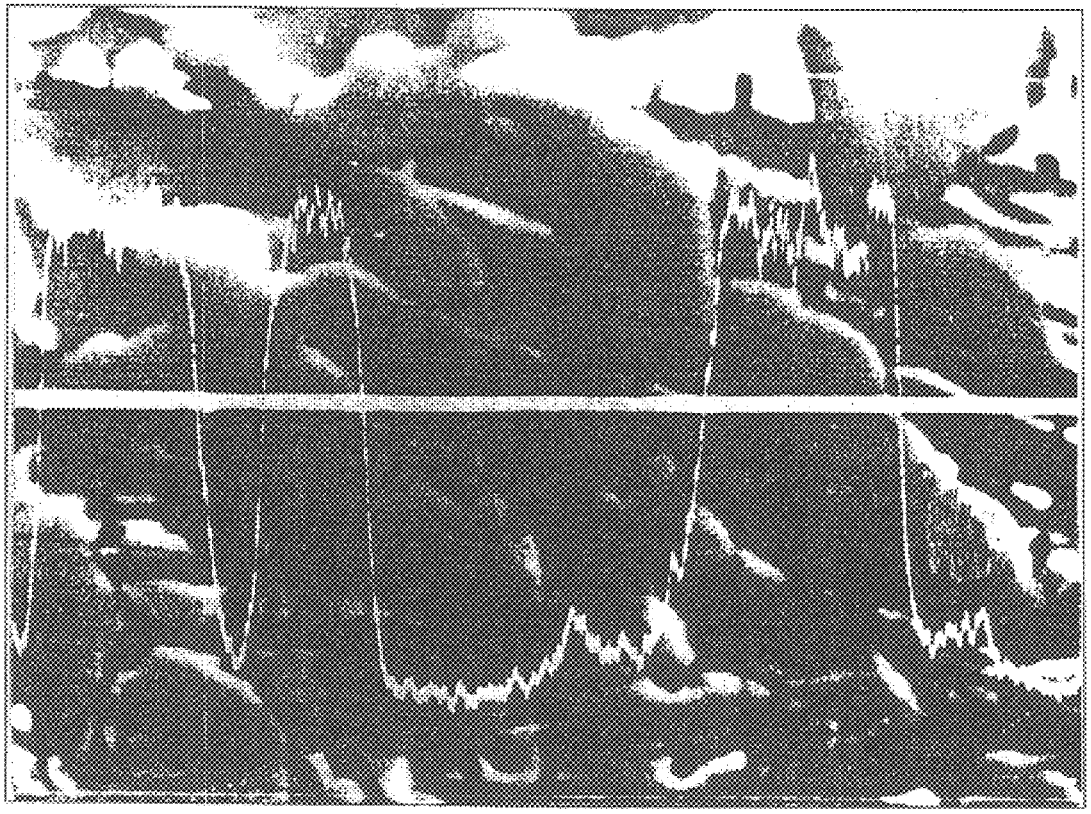
Figure 1D:
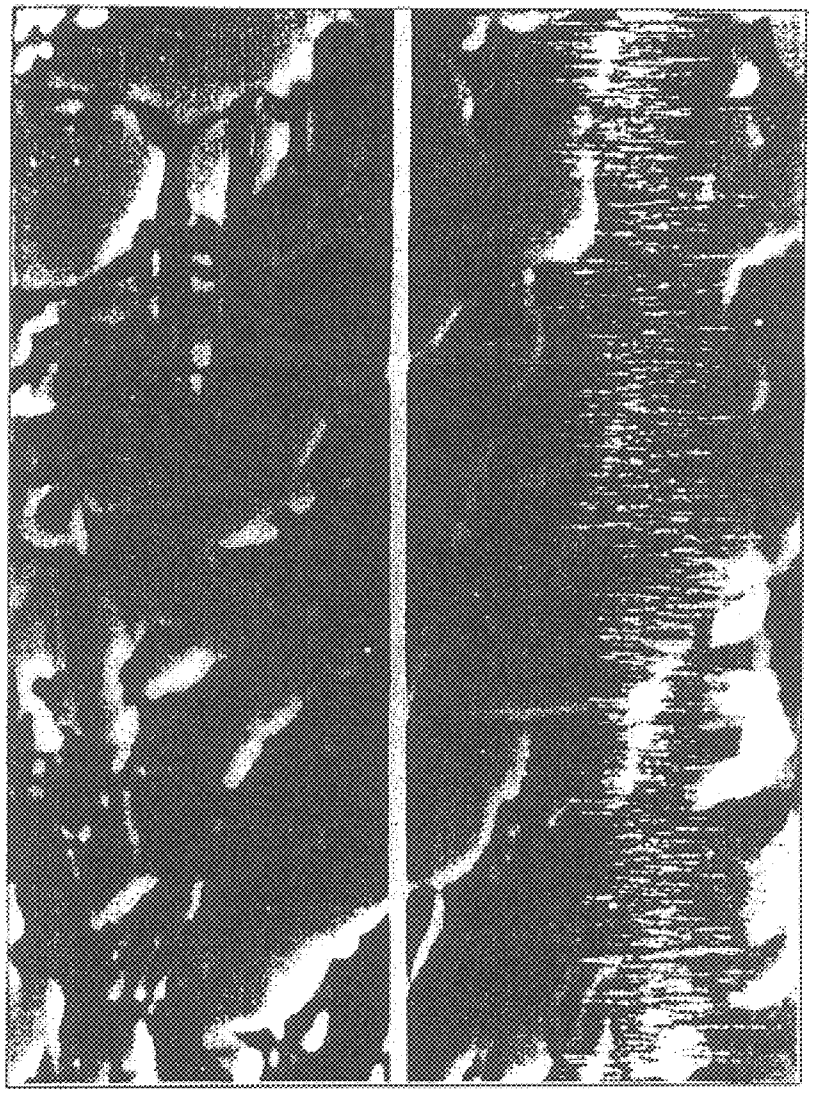

Referring to FIGS. 1A through 1D, it is evident that the quaternary alloy according to the present invention is composed of a gray phase and a white phase. Referring to FIGS. 1B and 1C showing the metal content profiles, it is understood that little tungsten and hafnium exist in the gray phase of the alloy. Referring to FIG. 1A showing the content profile of cerium, it is understood that little cerium exists in the white phase of the alloy. In practice, the quantitative analysis of the contents of the metals present in the respective phases of the alloy showed that the gray phase consists of 16.155% by weight of cerium, 83.280% by weight of iridium, 0.000% by weight of tungsten and 0.259% by weight of hafnium. From this result, it is evident that the gray phase is formed by two main metals, that is, cerium and iridium. Also, the quantitative analysis showed that the white phase consists of 0.118% by weight of cerium, 6.851% by weight of tungsten, 15.534% by weight of hafnium and 77.497% by weight of iridium. From this result, it is evident that the white phase is formed by three metals, that is, tungsten, hafnium and iridium, with little cerium being present therein.

EXAMPLE 1

First, gettering was performed with respect to a chamber before melting ingot. Then, 9 g of cerium was melted in an argon-arc furnace with a current of 120 A using a tungsten electrode and then 80.5 g of iridium was melted with a current of 180 A to prepare $Ir_5Ce$. Here, the melted material was overturned several times during melting so that both metals are well reacted with each other. Thereafter, 10 g of hafnium and 0.5 g of tungsten were melted in an arc furnace to prepare an alloy of $Hf_3W$. Subsequently, the alloy of the prepared $Ir_5Ce$ and $Hf_3W$ were melted. Here, the melted material was overturned several times during melting so that four metals contained in the alloy were reacted well with one another.

The quaternary alloy ingot was slantingly placed or the wall of a concave boat-shaped bottom plate in arc furnace and then arc discharge was performed from the edge of it to melt the ingot, thereby removing residual gases in the ingot. Then, the ingot removed residual gases was re-melted and then solidified slowly so that cracks were not generated, thereby preparing a quaternary alloy consisting of 9.0% by weight of cerium, 0.5% by weight of tungsten, 10.0% by weight of hafnium and the balance of iridium.

Then, an emitter was manufactured using the quaternary alloy.

EXAMPLE 2

An emitter was manufactured in the same manner as that in Example 1, except that the quaternary alloy consisting of 6.0% by weight of cerium, 2.0% by weight of tungsten, 6.0% by weight of hafnium and the balance of iridium was prepared using 6.0 g of cerium, 2.0 g of tungsten, 6.0 g of hafnium and 86 g of iridium.

EXAMPLE 3

An emitter was manufactured in the same manner as that in Example 1, except that the quaternary alloy consisting of 5.0% by weight of cerium, 5.0% by weight of tungsten, 5.0% by weight of hafnium and the balance of iridium was prepared using 5.0 g of cerium, 5.0 g of tungsten, 5.0 g of hafnium and 85 g of iridium.

EXAMPLE 4

An emitter was manufactured in the same manner as that in Example 1, except that the quaternary alloy consisting of 5.0% by weight of cerium, 10.0% by weight of tungsten, 5.0% by weight of hafnium and the balance of iridium was prepared using 5.0 g of cerium, 10.0 g of tungsten, 5.0 g of hafnium and 80 g of iridium.

EXAMPLE 5

An emitter was manufactured in the same manner as that in Example 1, except that the quaternary alloy consisting of 6% by weight of cerium, 5% by weight of tungsten, 3.0% by weight of hafnium and the balance of iridium was prepared using 6 g of cerium, 5 g of tungsten, 3.0 g if hafnium and 86 g of iridium.

EXAMPLE 6

An emitter was manufactured in the same manner as that in Example 1, except that the quaternary alloy consisting of 0.5% by weight of cerium, 15.0% by weight of tungsten, 0.5% by weight of hafnium and the balance of iridium was prepared using 0.5 g of cerium, 15.0 g of tungsten, 0.5 g of hafnium and 84 g of iridium.

COMPARATIVE EXAMPLE 1

5.0% by weight of cerium, 5.0% by weight of tungsten and the balance of iridium were melted in an argon-arc furnace and solidified to prepare a ternary alloy.

Then, an emitter was manufactured using the ternary alloy.

COMPARATIVE EXAMPLE 2

An emitter was manufactured in the same manner as that in Example 1, except that the quaternary alloy consisting of 10.0% by weight of cerium, 0.4% by weight of tungsten, 11.0% by weight of hafnium and the balance of iridium was prepared using 10.0 g of cerium, 0.4 g of tungsten, 11.0 g of hafnium and 78.6 g of iridium.

COMPARATIVE EXAMPLE 3

An emitter was manufactured in the same manner as that in Example 1, except that the quaternary alloy consisting of 5.0% by weight of cerium, 20.0% by weight of tungsten, 5.0% by weight of hafnium and the balance of iridium was prepared using 5.0 g of cerium. 20.0 g of tungsten, 5.0 g of hafnium and 70.0 g of iridium.

COMPARATIVE EXAMPLE 4

An emitter was manufactured in the same manner as that in Example 1, except that the quaternary alloy consisting of 0.4% by weight of cerium, 10.0% by weight of tungsten, 5.0% by weight of hafnium and the balance of iridium was prepared using 0.4 g of cerium, 20.0 g of tungsten, 5.0 g of hafnium and 84.6 g of iridium.

COMPARATIVE EXAMPLE 5

An emitter was manufactured in the same manner as that in Example 1, except that the quaternary alloy consisting of 5.0% by weight of cerium, 10.0% by weight of tungsten, 0.4% by weight of hafnium and the balance of iridium was prepared using 5.0 g of cerium, 10.0 g of tungsten, 0.4 g of hafnium and 84.6 g of iridium.

COMPARATIVE EXAMPLE 6

An emitter was manufactured in the same manner as that in Example 1, except that the quaternary alloy consisting of 5.0% by weight of cerium, 10.0% by weight of tungsten, 11.0% by weight of hafnium and the balance of iridium was prepared using 5.0 g of cerium, 10.0 g of tungsten, 11.0 g of hafnium and 74.0 g of iridium.

The emitters manufactured in Examples 1 through 6 and Comparative Examples 1 through 6 were placed into experimental vacuum diode(evacuated glass cylinders equipped with anode for receiving emission current), to measure the density of emission current generated from the emitters and the work function, and the measurement results are given in Table 1. Here, the temperatures of emitters were measured optically through the glass of cylinder with an OPPIR-17 type optical pyrometer. The temperatures measured when the density of emission current is equal to 5 $A/cm^2$ were regarded as working temperatures, and the work function of the alloy was determined from the slope of the temperature dependence on the density of emission current.

TABLE 1

| Type | Composition of alloy Ce (wt %) | W (wt %) | Hf (wt %) | Ir (wt %) | Work function (eV) | Working temperature (° C.) |
|---|---|---|---|---|---|---|
| Example 1 | 9.0 | 0.5 | 10 | Balance | 2.57 | 1440 |
| Example 2 | 6.0 | 2.0 | 6.0 | Balance | 2.52 | 1410 |
| Example 3 | 5.0 | 5.0 | 5.0 | Balance | 2.51 | 1400 |
| Example 4 | 5.0 | 10.0 | 5.0 | Balance | 2.53 | 1420 |
| Example 5 | 6.0 | 5.0 | 3.0 | Balance | 2.50 | 1400 |
| Example 6 | 0.5 | 15.0 | 0.5 | Balance | 2.58 | 1450 |
| Comparative Example 1 | 5.0 | 5.0 | 0 | Balance | 2.60 | 1500 |
| Comparative Example 2 | 10.0 | 0.4 | 11 | Balance | 2.59 | 1450 |
| Comparative Example 3 | 5.0 | 20.0 | 5.0 | Balance | 2.61 | 1500 |
| Comparative Example 4 | 0.4 | 10.0 | 5.0 | Balance | 2.61 | 1500 |
| Comparative Example 5 | 5.0 | 10.0 | 0.4 | Balance | 2.61 | 1480 |
| Comparative Example 6 | 5.0 | 10.0 | 11.0 | Balance | 2.63 | 1560 |

From Table 1, it was appreciated that the working temperatures of the emitters in Examples 1 through 6, having the alloy composition according to the present invention, were considerably lower than those of the emitters in Comparative Examples 1 through 6. that is, 1450° C. or below, while retaining its high emissive properties. In particular, the working temperatures of the emitters in Examples 1 through 6 were 50–100° C. lower than the working temperature of the emitter in Comparative Example 1, that is, the emitter having a ternary alloy of cerium, tungsten and iridium.

Figure 2:
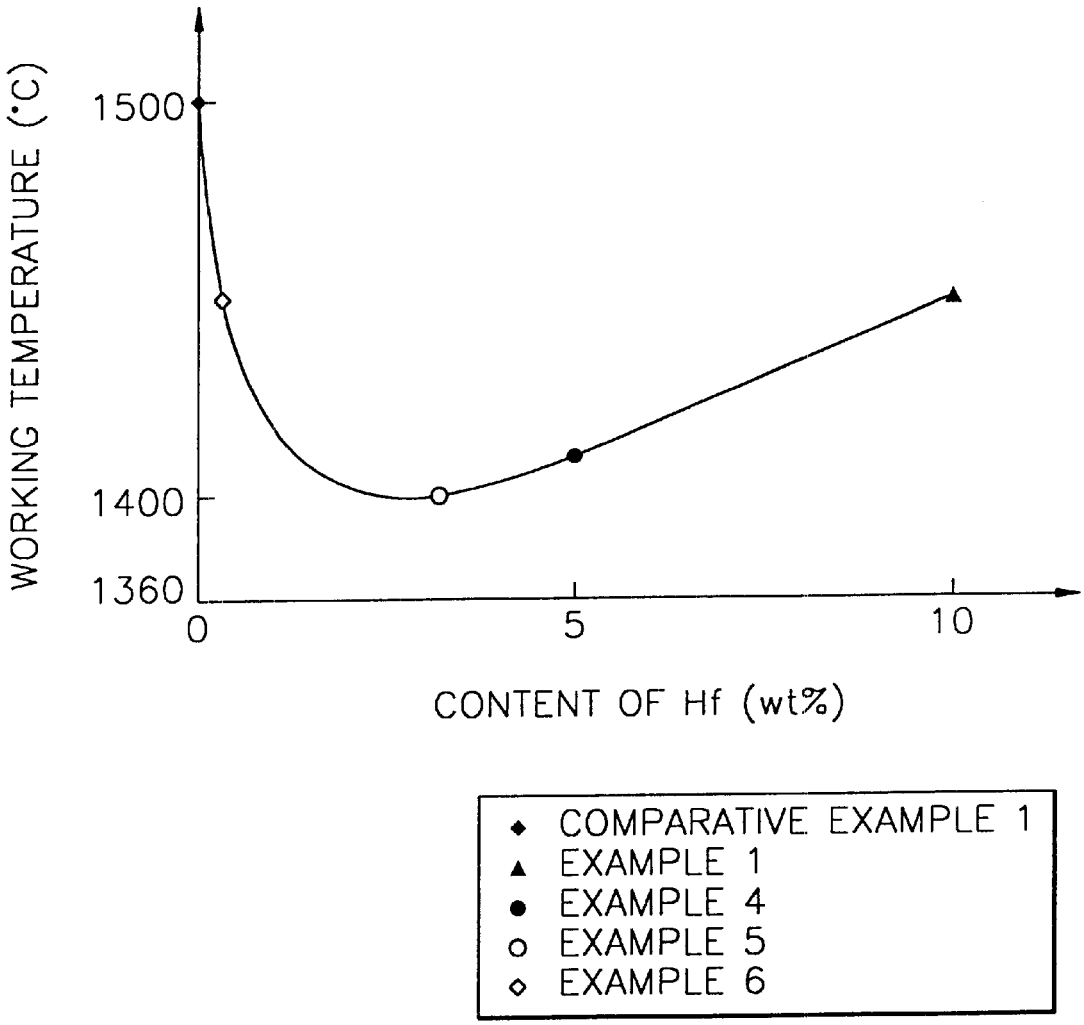
FIG. 2 is a graph illustrating the working temperature of an emitter depending on the change in the content of hafnium, in the emitter manufactured using a quaternary alloy including cerium, tungsten, hafnium and iridium.

Referring to FIG. 2, the working temperature of the emitter was 1500° C. when the content of hafnium contained in the quaternary alloy of the present invention was 0% by weight (Comparative Example 1). However, as the content of hafnium in the quaternary alloy increased (Examples 6 and 5), the working temperatures of emitters were sharply lowered. This is presumably because the diffusion rate of cerium into the alloy surface increases as the content of hafnium in the quaternary alloy increases. If the content of hafnium in the quaternary alloy exceeds 3% by weight, the working temperature of the emitter slowly increases (Example 4). If the content of hafnium in the quaternary alloy exceeds 10% by weight, the working temperature of the emitter is over 1450° C., which shortens the lifetime of the emitter.

Figure 3:
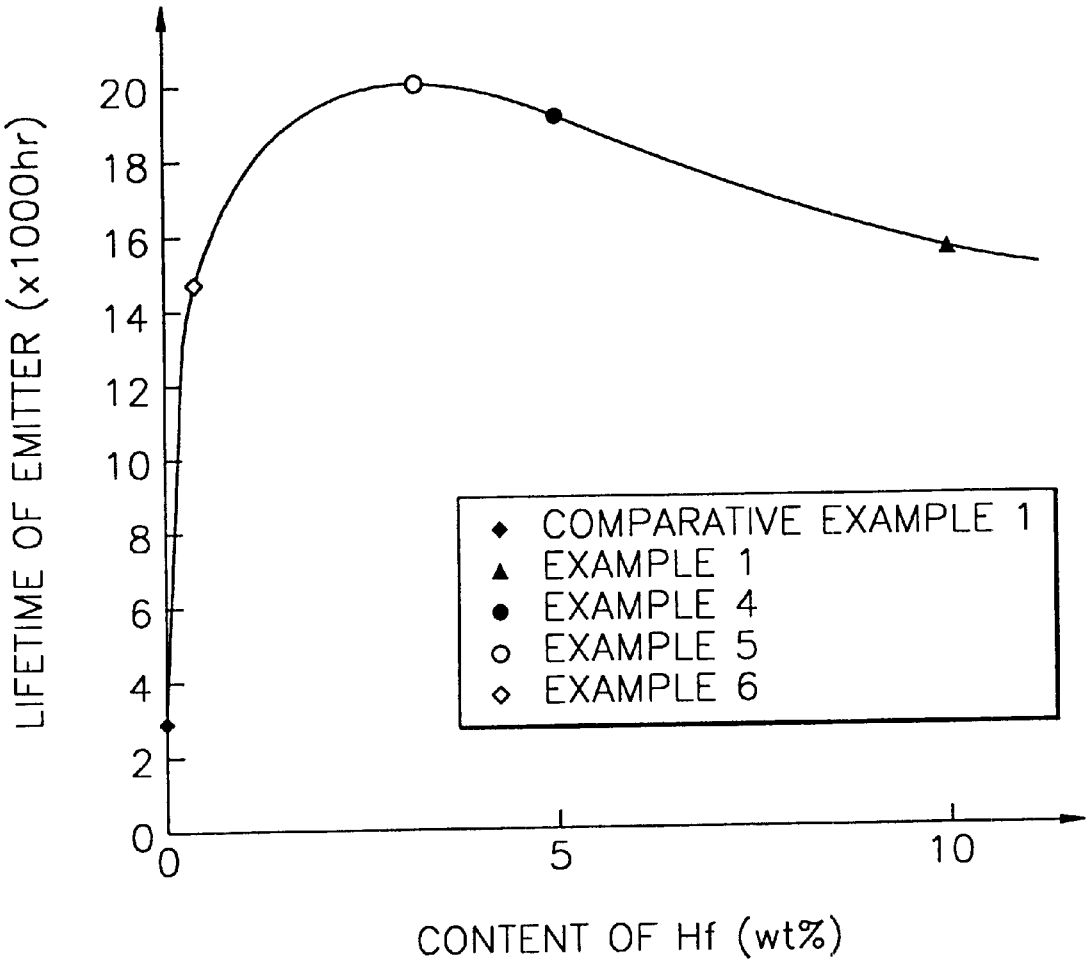
FIG. 3 is a graph illustrating the lifetime of an emitter depending on the change of the content of Hafnium, in the emitter manufactured using a quaternary alloy including cerium, tungsten, hafnium and iridium.

The lifetime of an emitter at a specific temperature is determined by the evaporation rate of a rare-earth metal of the cerium group. If the working temperature of an emitter is low, the evaporation rate of a rare-earth metal of the cerium group is decreased. Thus, the lifetime of the emitter is prolonged (see FIG. 3). Therefore. it is concluded that the lifetime of the emitter having the quaternary alloy of the present invention is longer than that of the emitter having the ternary alloy, at an equal density of emission current.

The evaporation rate of a rare-earth metal of the cerium group can be calculated by Equation (1), and the lifetime of an emitter can be calculated by Equation (2). The calculated lifetime of a 0.6 mm×0.6mm×0.2 mm emitter having the quaternary alloy according to the present invention was 15000–20000 hours, which is suitable for the lifetime dimension required by emitters for up-to-date electron beam devices, specifically CRT.

$$\gamma=\gamma_0\exp(-U_g/kT) \quad (1)$$

where $\gamma$ denotes the evaporation rate of cerium atoms, $\gamma_0$ denotes the evaporation coefficient, $U_g$ denotes the desorption energy of a rare-earth metal atoms of the cerium group from the alloy surface. k denotes the Boltzmann constant, and T denotes the absolute temperature.

$$t=m/(\gamma\cdot s) \quad (2)$$

where t denotes the lifetime of an emitter, m denotes the weight of a rare-earth metal of the cerium group in the emitter, and s denotes the area of the emitter.

Since the cathode material, that is, the quaternary alloy, according to the present invention has excellent plasticity, it is easy to manufacture small-size emitters. Also, since the density of the electron emission of the quaternary alloy according to the present invention is high and the working temperature is low, a long lifetime can be ensured.

Industrial Applicability

The cathode material according to the present invention is useful as an electron emitting source of various evacuated electron beam devices and cathode ray tubes.

What is claimed is:

1. A cathode material of an electron beam device comprising 0.5 to 9.0% by weight of a rare-earth metal of the cerium group, 0.5 to 15.0% by weight of tungsten and/or rhenium, 0.5 to 10% by weight of hafnium and the balance of iridium.

2. The cathode material according to claim 1, wherein the rare-earth metal of the cerium group is at least one selected from the group consisting of lanthanum, cerium. praseodymium, neodymium and samarium.

3. The cathode material according to claim 1, wherein the content of hafnium is in the range of 2 to 5% by weight.

4. The cathode material according to claim 1, wherein the cathode material consists of double phases of a gray phase composed of cerium and iridium and a white phase composed of tungsten, hafnium and iridium.

5. A method of preparing a cathode material according to claim 1, comprising the steps of:

(a) preparing $Ir_5Ce$ by melting iridium and cerium;

(b) preparing $Hf_3W$ by melting hafnium and tungsten; and (c) melting the alloy of the $Ir_5Ce$ and $Hf_3W$ prepared in steps (a) and (b) to prepare ingot of quaternary alloy.

6. The method according to claim 5, further comprising the step of (d) re-melting the ingot prepared in step (c) and slowly solidifying the same so that cracks are not generated.

* * * * *